US009494345B2

(12) United States Patent
Heinbokel et al.

(10) Patent No.: US 9,494,345 B2
(45) **Date of Patent: *Nov. 15, 2016**

(54) REFRIGERATION CIRCUIT AND METHOD FOR OPERATING A REFRIGERATION CIRCUIT

(71) Applicant: Carrier Corporation, Farmington, CT (US)

(72) Inventors: Bernd Heinbokel, Köln (DE); Andreas Gernemann, Flensburg (DE); Uwe Schierhorn, Wesseling (DE)

(73) Assignee: Carrier Corporation, Jupiter, FL (US)

( * ) Notice: Subject to any disclaimer, the term of this patent is extended or adjusted under 35 U.S.C. 154(b) by 227 days.

This patent is subject to a terminal disclaimer.

(21) Appl. No.: 14/499,852

(22) Filed: Sep. 29, 2014

(65) Prior Publication Data

US 2015/0013359 A1 Jan. 15, 2015

Related U.S. Application Data

(62) Division of application No. 13/227,550, filed on Sep. 8, 2011, now Pat. No. 8,844,303, which is a division of application No. 11/659,926, filed as application No. PCT/EP2005/008255 on Jul. 29, 2005, now Pat. No. 8,113,008.

(30) Foreign Application Priority Data

Aug. 9, 2004 (DE) ..... 10 2004 038 640

(51) Int. Cl.
*F25B 9/00* (2006.01)
*F25B 41/04* (2006.01)

(Continued)

(52) U.S. Cl.
CPC ..... *F25B 9/008* (2013.01); *F25B 1/005* (2013.01); *F25B 41/04* (2013.01); *F25B 1/10* (2013.01);

(Continued)

(58) Field of Classification Search
CPC ..... F25B 1/005; F25B 40/04; F25B 2400/22
See application file for complete search history.

(56) References Cited

U.S. PATENT DOCUMENTS 933,682 A 9/1909 Voorhees
1,860,447 A 5/1932 Bergdoll (Continued)

FOREIGN PATENT DOCUMENTS

DE 4309137 A1 8/1994
DE 19522884 A1 1/1997

(Continued)

OTHER PUBLICATIONS

Dirk Gebhardt et al., Development of a Supermarket Transcritical Multistage Refrigerating Plant for Chilling and Freezing, pp. 54-65, Oct. 1, 2003, Stuttgart, Germany.

(Continued)

*Primary Examiner* — Emmanuel Duke
(74) *Attorney, Agent, or Firm* — Bachman & LaPointe, P.C.

(57) ABSTRACT

The invention relates to a refrigeration circuit having a mono- or multi-component refrigerant circulating therein, said refrigeration circuit comprising, in the direction of flow, a condenser, a collecting container, a relief device connected upstream of an evaporator, an evaporator and a compressor unit with single-stage compression. According to the invention, there is an intermediate relief device arranged between the condenser and the collecting container. Furthermore, there is disclosed a method of operating a refrigeration device in which pressure relief of the refrigerant to an (intermediate) pressure of 5 to 40 bar is effected in the intermediate relief device arranged between the condenser and the collecting container.

22 Claims, 4 Drawing Sheets

(51) Int. Cl.

| | |
|---|---|
| ***F25B 1/00*** | (2006.01) |
| *F25B 1/10* | (2006.01) |
| *F25B 5/02* | (2006.01) |
| *F25B 40/04* | (2006.01) |
| *F25B 49/02* | (2006.01) |

(52) U.S. Cl.

CPC ..... *F25B 5/02* (2013.01); *F25B 40/04* (2013.01); *F25B 49/022* (2013.01); *F25B 2309/061* (2013.01); *F25B 2400/075* (2013.01); *F25B 2400/13* (2013.01); *F25B 2400/22* (2013.01); *F25B 2400/23* (2013.01)

(56) References Cited

U.S. PATENT DOCUMENTS

| | | | | |
|---|---|---|---|---|
| 2,585,908 | A | 2/1952 | Backstrom | |
| 2,680,956 | A | 6/1954 | Haas | |
| 3,735,600 | A | 5/1973 | Dowdell et al. | |
| 4,430,866 | A | 2/1984 | Willitts | |
| 4,551,983 | A | 11/1985 | Atsumi et al. | |
| 4,599,873 | A | 7/1986 | Hyde | |
| 4,621,505 | A | 11/1986 | Ares et al. | |
| 4,742,694 | A | 5/1988 | Yamanaka et al. | |
| 4,831,835 | A | 5/1989 | Beehler et al. | |
| 5,042,262 | A | 8/1991 | Gyger et al. | |
| 5,056,329 | A | 10/1991 | Wilkinson | |
| 5,103,650 | A | 4/1992 | Jaster | |
| 5,400,615 | A | 3/1995 | Pearson | |
| 6,076,367 | A | 6/2000 | Sandofsky et al. | |
| 6,112,532 | A * | 9/2000 | Bakken | F25B 9/008 62/149 |
| 6,276,148 | B1 | 8/2001 | Shaw | |
| 6,446,450 | B1 | 9/2002 | Pressler | |
| 6,470,693 | B1 | 10/2002 | Dickey | |
| 6,694,763 | B2 * | 2/2004 | Howard | F25B 9/008 62/115 |
| 2003/0102113 | A1 | 6/2003 | Memory et al. | |
| 2004/0069004 | A1 | 4/2004 | Gist et al. | |
| 2004/0093893 | A1 | 5/2004 | Tanimoto et al. | |

FOREIGN PATENT DOCUMENTS

| | | | | |
|---|---|---|---|---|
| EP | 0180904 | A2 | 5/1986 | |
| EP | 0306405 | A1 | 3/1989 | |
| EP | 0431797 | A2 | 6/1991 | |
| EP | 0529882 | A2 | 3/1993 | |
| EP | 0541343 | A1 | 5/1993 | |
| EP | 1046869 | B1 | 10/2000 | |
| EP | 1050726 | A2 | 11/2000 | |
| EP | 1162414 | A1 | 12/2001 | |
| FR | 2738331 | A1 * | 3/1997 | F25B 41/065 |
| JP | 55-23859 | A | 2/1980 | |
| JP | 61-64526 | A | 4/1986 | |
| JP | 1-318860 | A | 12/1989 | |
| JP | 08-005163 | A | 1/1996 | |
| JP | 2003-254661 | A | 9/2003 | |
| WO | 9910686 | A1 | 3/1999 | |

OTHER PUBLICATIONS

P. Schiesaro et al., Development of a Two Stage CO2 Supermarket System, IIR Conference, New Technologies in Commercial Refrigeration, Jul. 22, 2002, Urbana, IL, USA.

International Search Report for PCT/EP2005/008255, dated Nov. 21, 2005.

European Search Report for EP07020311.2, dated Jan. 14, 2009.

New Zealand Examination Report for NZ552762, dated Sep. 29, 2008.

Chinese Office Action for CN200580026836.8, dated Feb. 15, 2008.

Chinese Office Action for CN200580026836.8, dated Oct. 17, 2008.

Chinese Office Action for CN200580026836.8, dated Apr. 17, 2009.

P. Ostertag, Kaelteprozesse Dargestellt Mit Hilfe Der Entropietafel, Passage, 1933, pp. 1-67, Verlag von Julius Springer, Berlin, Germany.

G.K. Lavrenchenko et al., Characteristics of Voorhees Refrigerating Machine with Hermetic Piston Compressor Producing Refrigeration at One or Two Temperature Levels, pp. 517-527, 1997, Elsevier Science Ltd. and HR, Great Britain.

Hans-Joachim Huff et al., Options for a Two-Stage Transcritical Carbon Dioxide Cycle, Joint Conference of the International Institute of Refrigeration, pp. 158-164, Sep. 17, 2002, College Park, Maryland.

Jeff Staub et al., CO2 As Refrigerant: The Transcritical Cycle, Jan. 26, 2004,www.achrnews.com/Articles/Feature_Article/97d657d6f5d5a010VCM100000f9.

Australian Office action for AU Patent Application No. 2005270472, dated Oct. 20, 2009.

* cited by examiner

REFRIGERATION CIRCUIT AND METHOD FOR OPERATING A REFRIGERATION CIRCUIT

CROSS-REFERENCE TO RELATED APPLICATIONS

This is a divisional of U.S. patent application Ser. No. 13/227,550, filed Sep. 8, 2011 which is a divisional of U.S. patent application Ser. No. 11/659,926, filed Feb. 9, 2007 entitled "Refrigeration Circuit and Method of Operating a Refrigeration Circuit", now U.S. Pat. No. 8,113,008, issued Feb. 14, 2012, which is the 35 USC 371 National Phase of International Application PCT/EP2005/008255, filed Jul. 29, 2005 and priority is claimed of DE102004038640.4, the disclosures of which International application and German application are incorporated by reference herein in their entireties as if set forth at length.

BACKGROUND OF THE INVENTION

The invention relates to a refrigeration circuit having a mono- or multi-component refrigerant circulating therein, said circuit comprising, in the direction of flow, a condenser, a collecting container, a relief device connected upstream of an evaporator, an evaporator and a compressor unit with single-stage compression.

Furthermore, the invention relates to a method of operating a refrigeration circuit.

The term "condenser" is to be understood to comprise both condensers and gas coolers.

Refrigeration circuits of the type concerned are well known. They are realized, for example, in refrigerating plants, so-called composite refrigerating plants, as used in supermarkets. In general, composite refrigerating plants feed there a multiplicity of cold consumers, such as cold storages, refrigerating and deep-freezing furniture. To this end, a mono- or multi-component refrigerant or refrigerant mixture circulates in the same.

A refrigeration circuit or refrigerating plant according to the prior art, realizing such a refrigeration circuit, shall be elucidated in more detail by way of the example illustrated in FIG. 1.

The mono- or single component refrigerant circulating in the refrigeration circuit is condensed in a condenser or gas cooler A—in the following briefly referred to as condenser only—which as a rule is arranged outside of a supermarket, e.g. on the roof thereof, by exchange of heat, preferably with respect to outside air.

The liquid refrigerant from the condenser A is supplied via a line B to a (refrigerant) collector C. Within a refrigeration circuit it is necessary at all times that sufficient refrigerant is present so that also in case of maximum refrigeration requirements the condensers of all cold consumers can be filled. However, due to the fact that in case of lower refrigeration requirements, some condensers are filled only partially or even are completely empty, the surplus of refrigerant during these times has to be collected in the collector C provided therefor.

From the collector C, the refrigerant passes via liquid line D to the cold consumers of the so-called normal refrigeration circuit. In this regard, the consumers F and F' depicted in FIG. 1 stand for an arbitrary number of consumers of the normal refrigeration circuit. Each of the afore-mentioned cold consumers has an expansion valve E and E', respectively, connected upstream thereof, in which pressure relief of the refrigerant flowing into the cold consumer or the evaporator(s) of the cold consumer takes place. The thus pressure-relieved refrigerant is evaporated in the evaporators of the cold consumers F and F' and thereby refrigerates the corresponding refrigeration furniture and storage rooms.

The refrigerant evaporated in the cold consumers F and F' of the normal refrigeration circuit then is fed via suction line G to compressor unit H and is compressed therein to the desired pressure between 10 and 25 bar. As a rule, the compressor unit H is of single-stage design only and has a plurality of compressors connected in parallel.

The refrigerant compressed in the compressor unit H then is fed via pressure line I to the afore-mentioned condenser A.

Via a second liquid line D', refrigerant is fed from collector C to condensing means K and is evaporated therein, exchanging heat with the refrigerant of the deep-freeze circuit still to be elucidated, before it is supplied via line G' to compressor unit H.

The refrigerant of the deep-freezing circuit liquefied in condensing means K is supplied via line L to the collector M of the deep-freeze circuit. From the latter, the refrigerant is passed via line L to consumer P—which stands for an arbitrary number of consumers—having a relief device O connected upstream thereof, and is evaporated therein. Via suction line Q, the evaporated refrigerant is fed to the single-stage or multi-stage compressor unit R and is compressed in the same to a pressure between 25 and 40 bar and thereafter is supplied to the afore-mentioned condensing means K via pressure line S.

The refrigerant used in the normal refrigeration circuit is e.g. R 404A, whereas carbon dioxide is utilized for the deep-freeze circuit.

The compressor units H and R shown in FIG. 1, the collectors C and M as well as the condensing means K as a rule are disposed in a separate machine room. However, about 80 to 90 percent of the entire line network are arranged in the sales rooms, storage rooms or other rooms of a supermarket that are accessible to staff members and customers. As long as this line network does not make use of pressures of more than 35 to 40 bar, this is acceptable to the supermarket operator both under psychological aspects and for reasons of costs.

SUMMARY OF THE INVENTION

Presently, there are changes being made, operating also the afore-mentioned normal refrigeration circuit with the refrigerant $CO_2$.

The sensible use of the natural refrigerant $CO_2$ in commercial refrigeration systems so far fails to be successful on the one hand due to the insufficient energetic efficiency of the simple, single-stage cycle process in case of high (external) air temperatures. On the other hand, due to the material properties of $CO_2$ there are high operating pressures—of up to 100 bar and above—necessary, which enormously aggravate the production of corresponding refrigeration circuits and refrigerating plants, respectively, for reasons of economy. Therefore, the refrigerant $CO_2$ so far is commercially employed in cascade systems for deep-freezing only—as illustrated in exemplary manner by way of FIG. 1—, as the operating pressures realized there are not in excess of the usual maximum pressure level of 40 bar.

Due to the afore-mentioned higher pressures or pressure level, the tubing network of the refrigeration circuit has to be designed for these pressures or this pressure level. However, the materials required therefor are by far more expensive than those that can be utilized for the pressure levels realized so far. In addition thereto, it is very difficult to convey the idea of such comparatively high pressure levels to the operators of the plants as well.

Another problem exists in particular in using $CO_2$ as refrigerant in that, in particular with correspondingly higher outer temperatures, transcritical operation of the refrigeration circuit becomes necessary. High external air temperatures have the result that comparatively high amounts of throttling vapour occur at the entry to the evaporator. The effective volumetric refrigerating power of the circulating refrigerant is reduced thereby, while however both the suction and the liquid lines as well as the evaporators need to have correspondingly larger dimensions in order to keep the pressure losses as low as possible.

It is the object of the present invention to indicate a refrigeration circuit as set out at the beginning as well as a method of operating a refrigeration circuit, in which the disadvantages mentioned are avoided.

To meet this object, there is suggested a refrigeration circuit which distinguishes itself in that an intermediate relief device is arranged between the condenser and the collecting container.

As regards the method, the underlying object is met in that pressure relief of the refrigerant to an (intermediate) pressure of 5 to 40 bar is effected in the intermediate relief device arranged between condenser and collecting container.

DETAILED DESCRIPTION

The refrigeration circuit according to the invention, the inventive method of operating a refrigeration circuit as well as further developments thereof will be elucidated in more detail hereinafter by way of the embodiments shown in FIGS. 2 to 4.

Figure 1:
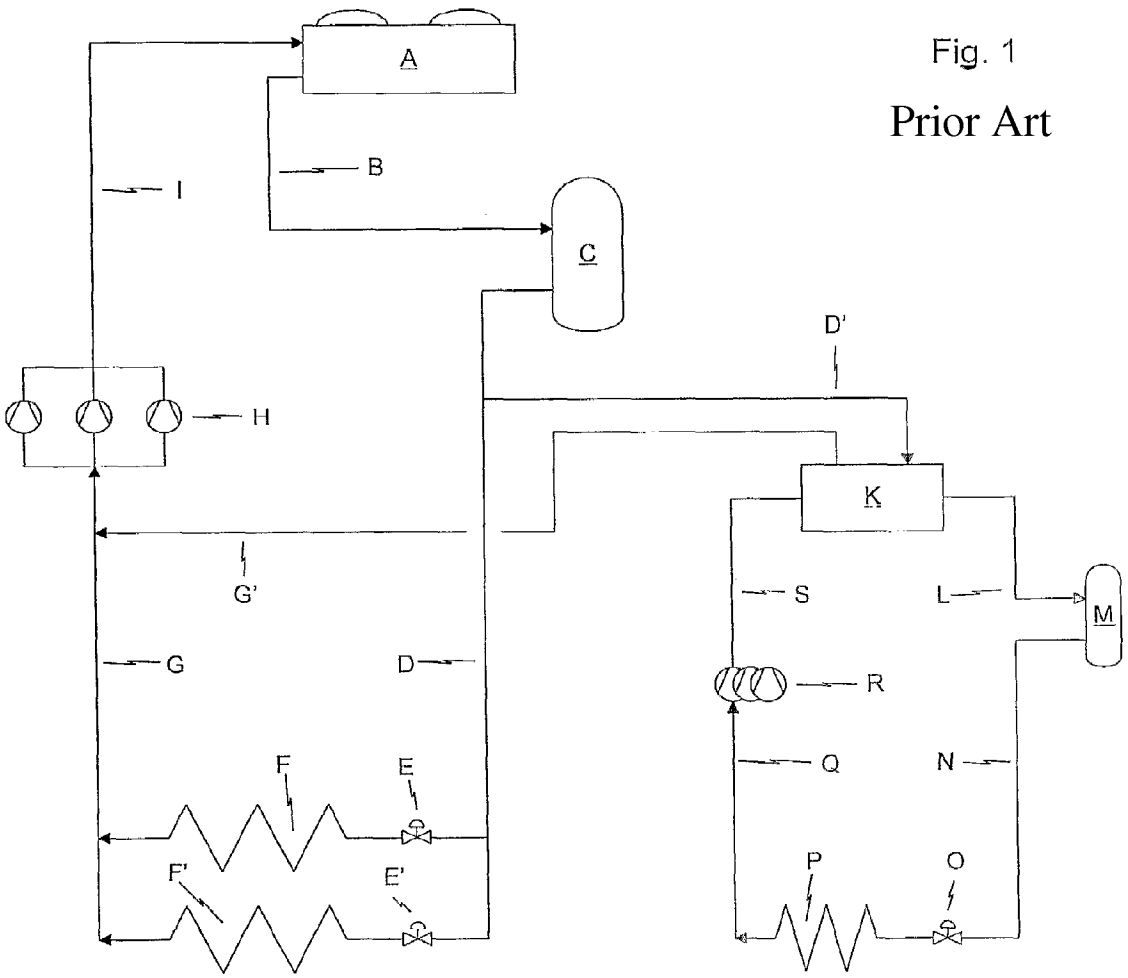
Fig. 1 Prior Art
FIG. 1 is a schematic view of a prior art refrigerating plant.
Figure 2:
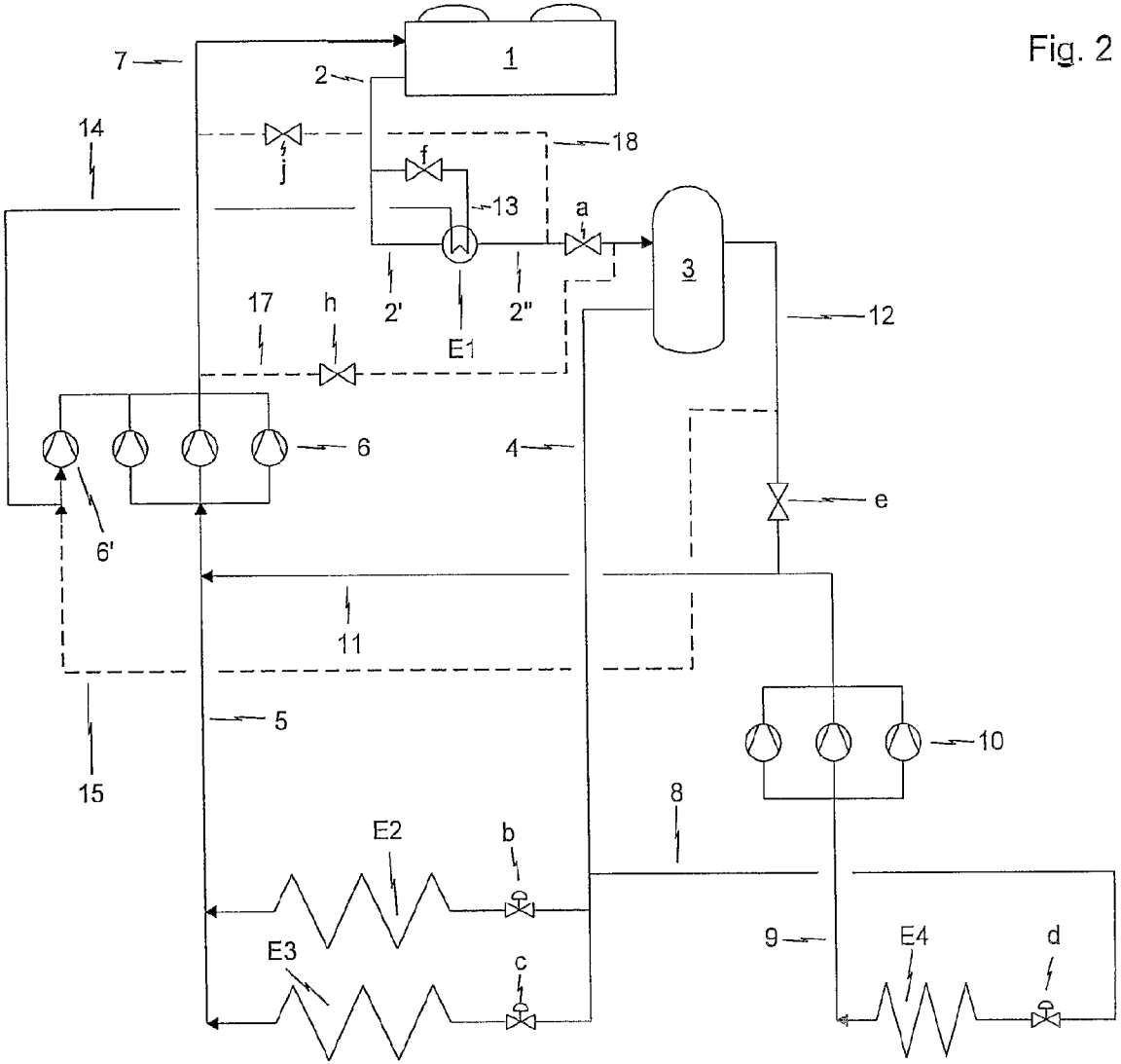
FIG. 2 is a schematic view of a refrigerating plant according to the present disclosure.

In this context, FIG. 2 illustrates a composite refrigeration plant in which a possible embodiment of the refrigeration circuit according to the invention is realized. In the following, a method shall be described in which halogenated fluorohydrocarbon(s), fluorohydrocarbon(s) or $CO_2$ may be used as refrigerants.

The refrigerant that is compressed in compressor unit 6 to a pressure between 10 and 120 bar is fed via pressure line 7 to condenser or gas cooler 1 and is condensed or cooled in the same by way of external air. Via lines 2, 2' and 2", the refrigerant is passed to refrigerant collector 3; however, according to the invention, the refrigerant now is pressure-relieved in intermediate relief device a to an intermediate pressure of 5 to 40 bar. This intermediate pressure relief provides for the advantage that the downstream tubing network as well as the collector 3 need to be designed for a lower pressure level only.

The pressure to which the refrigerant is relieved in said intermediate relief device a preferably is selected such that it is still underneath the lowest condensing or liquefying pressure to be expected.

In accordance with an advantageous development of the refrigeration circuit according to the invention, pressure line 7 is connected or adapted to be connected to collecting container 3, preferably to the gas space of the same. This connection between pressure line 7 and collecting container 3 may be effected e.g. via a connecting line 17 having a relief valve h disposed therein.

According to an advantageous development of the refrigeration circuit of the invention, pressure line 7 is connected or connectable to the line or line sections 2 and 2', 2", respectively, connecting the condenser 1 and the collecting container 3. This connection between pressure line 7 and line 2 or 2', 2", respectively, may be effected e.g. via the connecting line 18 shown in broken outline and having a valve j arranged therein.

According to an advantageous development of the refrigeration circuit of the invention, the collecting container 3, preferably the gas space thereof, is connected or connectable to the input of the compressor unit 6.

This connection between collecting container 3 and input of the compressor unit 6 may be established, for example, via a connecting line 12 which, as shown in FIG. 2, opens into suction line 11.

Via the relief valve e provided in line 12 as well as the relief valve h provided in line 17 or the valve j provided in line 18, the intermediate pressure chosen now may be kept constant for all operating conditions. However, it is also possible to provide for regulation such that a constant differential value with respect to the suction pressure is present. The effect achieved thereby is that the amount of throttling vapour at the evaporators is comparatively low, which has the result that the dimensioning of the liquid and suction lines may be correspondingly smaller. This holds also for the condensate line, as it is now no longer necessary that gaseous constituent parts flow back to the condenser 1 via the same. Thus, another effect achieved by the invention is that the required refrigerant filling amount may be reduced by up to approx. 30 percent.

Refrigerant is withdrawn from collector 3 via suction line 4 and is supplied to the refrigerant consumers and to the heat exchangers E2 and E3 of the same, respectively. Connected upstream thereof, there is a relief valve b and c, respectively, in which relief of the refrigerant flowing into the cold consumers takes place. The refrigerant evaporated in the cold consumers E2 and E3 subsequently is again fed via suction line 5 to compressor unit 6 or is sucked from the evaporators E2 and E3 via said suction line 5.

Part of the refrigerant withdrawn from collector 3 via line 4 is fed via line 8 to one or more deep-freeze consumers—illustrated in the form of heat exchanger E4—which also has a relief valve d connected upstream thereof. This partial refrigerant flow, after evaporation in the heat exchanger or cold consumer E4, is fed via suction line 9 to compressor unit 10 and compressed in the same to the input pressure of the compressor unit 6. The thus compressed partial refrigerant flow then is fed via line 11 to the input side of compressor unit 6.

As a further development of the invention, it is suggested that—as illustrated in FIG. 2—the collecting container 3 may have a heat transfer means E1 connected upstream thereof.

The heat transfer means E1 preferably is connected or connectable on the input side to the output of condenser 1.

As shown in FIG. 2, a partial flow of the condensed or cooled refrigerant can be withdrawn via a line 13, having a relief valve f arranged therein, from the condenser or gas cooler 1 and line 2, respectively, and can be evaporated in heat transfer means E1 by way of the refrigerant to be cooled which is fed to heat transfer means E1 via line 2'. The evaporated partial refrigerant flow then is fed via line 14 to a compressor 6' which is associated with the compressor unit 6 described hereinbefore and which preferably performs sucking-on at a higher pressure level; in the same, the evaporated partial refrigerant flow then is compressed to the desired final pressure of compressor unit 6.

As an alternative to the afore-mentioned (additional) compressor 6', it is also possible to make use of multi-cylinder compressors and to then deliver the amount of throttling vapour to be sucked off, to one or several cylinders of each compressor at a higher pressure level.

By way of the heat transfer means E1, the refrigerant flow to be pressure-relieved in the intermediate relief device a preferably is cooled to such an extent that the amount of throttling vapour of the pressure-relieved refrigerant is minimized.

As an alternative or in addition thereto, the amounts of throttling vapour arising in collector 3 may also be sucked off at a higher pressure level via line 12 as well as line 15 shown in broken outline by means of compressor 6'.

Figure 3:
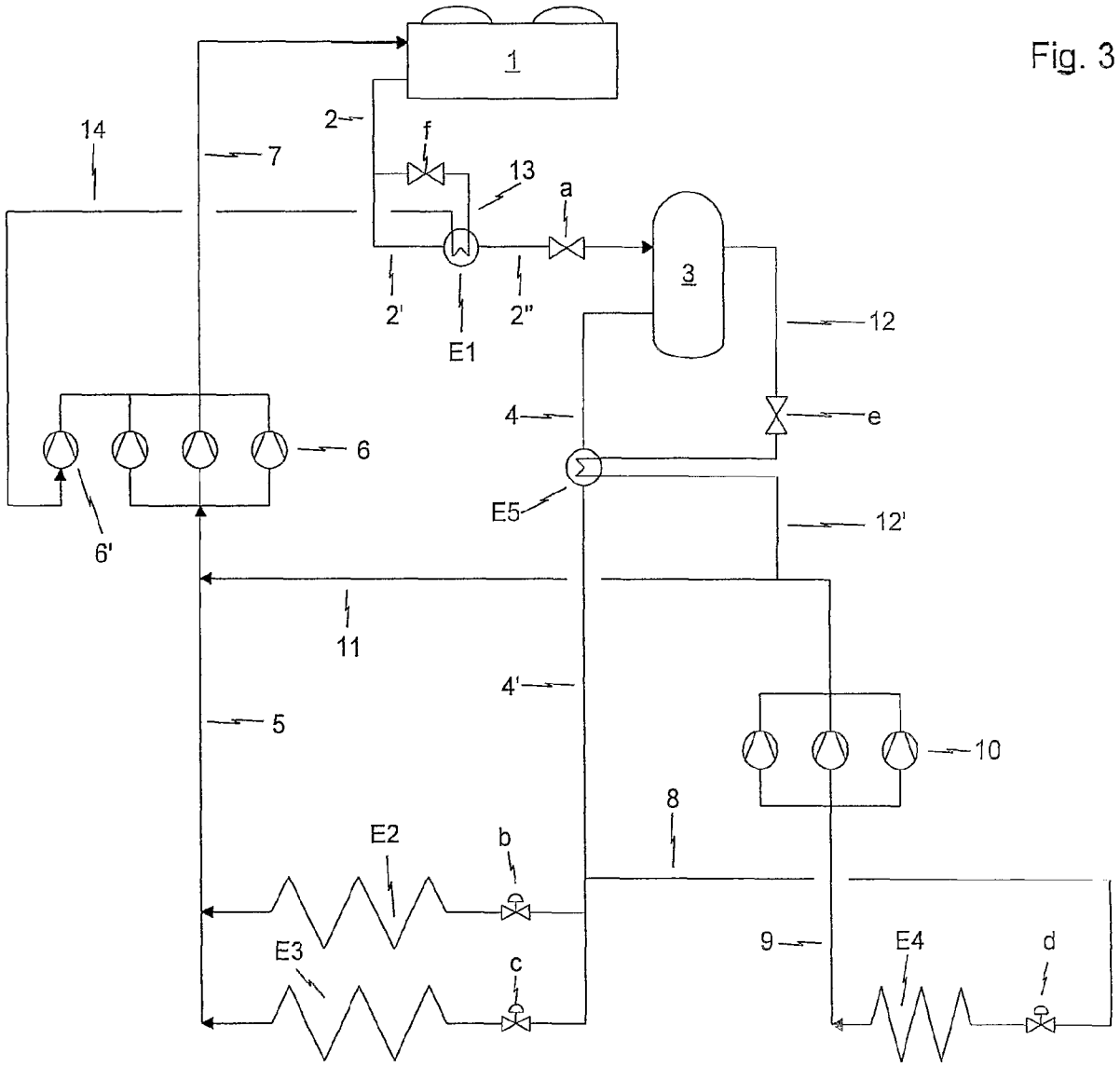
FIG. 3 is a schematic view of a second refrigerating plant according to the present disclosure.

FIG. 3 illustrates an embodiment of the refrigeration circuit according to the invention and of the inventive method of operating a refrigeration circuit in which the refrigerant withdrawn from collecting container 3 via line 4 is subjected to sub-cooling in heat exchanger E5.

In this context, sub-cooling—in accordance with an advantageous development of the invention—takes place in heat exchange with the flash gas withdrawn from collecting container 3 via line 12.

Liquid lines, such as e.g. line 4 shown in FIGS. 2 and 3, having a temperature level below ambient temperature are subject to heat radiation. The result of the latter is that the refrigerant flowing within the liquid line is partially evaporated, thus causing undesirable amounts of vapour to be formed. In order to prevent this, refrigerants so far are sub-cooled either by expansion of a partial flow of the refrigerant and subsequent evaporation or by an internal thermal transfer with respect to a suction gas flow which is thereby superheated.

In the refrigeration circuit according to the invention or the method according to the invention, the temperature distance between suction and liquid line and the refrigerant circulating therein, respectively, possibly may be too small for realizing an internal thermal transfer for the required sub-cooling of the refrigerant flowing in the liquid line.

Thus, it is suggested according to a further development of the invention—as already pointed out—that the refrigerant withdrawn from collecting container 3 via line 4 be sub-cooled in heat exchanger or sub-cooler E5 with respect to the flash gas from collecting container 3 via line 12, which is pressure-relieved or flash-relieved in valve e. After passage through the heat exchanger or sub-cooler E5, the pressure-relieved refrigerant that is superheated in heat exchanger E5 is fed via line sections 12' and 11 to the input of compressor unit 6. Due to superheating of the flash gas flow withdrawn from collecting container 3 via line 12, sufficient sub-cooling of the refrigerant flowing in line 4 is achieved in said line 4; such sub-cooling of the refrigerant enhances the regulating operation of the relief or injection valves b, c and d connected upstream of the evaporators E2, E3 and E4.

Liquid droplets that are not deposited from the collecting container 3 via line 12 due to too small dimensioning and/or excessive filling of the collecting container 3, and are carried along in the flash gas, will be evaporated at the latest in the heat exchanger/sub-cooler E5. The process described thus provides the additional advantage that the operational safety of the compressors or the compressor unit 6 is enhanced due to safe superheating of the flash gas flow.

Figure 4:
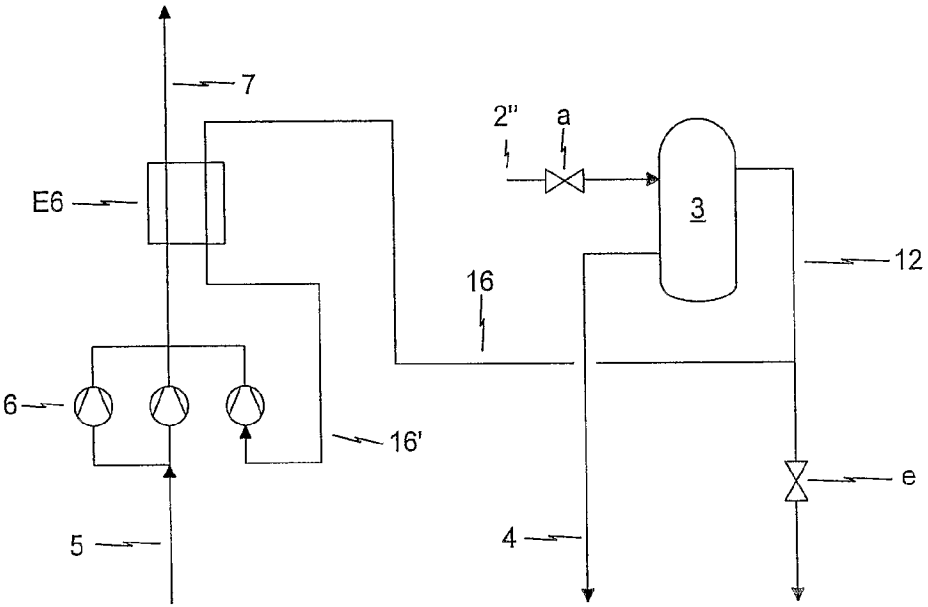
FIG. 4 is a partial schematic view of a third refrigerating plant according to the present disclosure.

FIG. 4 illustrates an additional development of the refrigeration circuit and the method of operating a refrigeration circuit according to the invention. For the sake of better visibility, FIG. 4 shows only sections of the refrigerant circuit according to the invention as shown in FIGS. 2 and 3.

As a further development of the inventive method of operating a refrigeration circuit, it suggested that at least a partial flow of the flash gas withdrawn from the collecting container is subject to overheating at least temporarily at least with respect to a partial flow of the compressed refrigerant.

FIG. 4 illustrates a possible development of the method according to the invention, in which a partial flow of the flash gas withdrawn from collecting container 3 via line 12 is at least temporarily supplied to a heat exchanger E6 via line 16 and is superheated in the same with respect to the refrigerant compressed in compressor unit 6.

In the process illustrated in FIG. 4, the flash gas flow to be superheated is superheated in heat exchanger E6 with respect to the entirety of the refrigerant flow compressed in compressor unit 6, which is fed via line 7 to the condenser or cooler that is not shown in FIG. 4.

Upon passage through the heat exchanger/superheater E6, the flash gas flow is fed via line 16' to the input of compressor 6' of compressor unit 6.

The process illustrated in FIG. 4 reliably ensures that liquid shares contained in the flash gas are evaporated without any doubt, which results in enhanced safety for the compressors or the compressor unit 6.

What is claimed is:

1. A refrigeration circuit having a refrigerant, especially CO2, circulating therein, said refrigeration circuit enabling a transcritical overcritical operation, said refrigeration circuit comprising, sequentially in the direction of flow:

a condenser/gas cooler (1);

an intermediate relief device (a);

a collecting container (3) having a gas space;

a relief device (b, c);

an evaporator (E2, E3); and a compressor unit (6) having an input connected to the evaporator (E2, E3) by a suction line (5), wherein:

a further compressor unit (10) as well as at least one freezing consumer (E4) having a relief valve (d) connected upstream of it are provided;

in operation, refrigerant is sucked off from the collecting container (3) and led, via the suction line (4), to the relief device (b, c), expanded therein, led to the evaporator (E2, E3), evaporated therein, and led to the compressor unit (6) via a suction line (5);

in operation, a refrigerant partial flow withdrawn from the collecting container (3) is led via the suction line (4) and a line (8) branching off the suction line (4) to the relief valve (d), expanded therein, led to the freezing consumer (E4), evaporated therein, and led to the further compressor unit (10) via a line (9);

in operation, the refrigerant partial flow is compressed by the further compressor unit (10) to the input pressure of the compressor unit (6) and led to the input side of the compressor unit (6) via a suction line (11, 5);

the gas space of the collecting container (3) is connected or connectible to the input of the compressor unit (6); and a relief valve (e) is in the connection line (11, 12) between the gas space of the collecting container (3) and the input of the compressor unit (6).

2. The refrigeration circuit of claim 1, wherein the line (11) from the further compressor unit (10) joins the suction line (5) at a position before the compressor unit (6).

3. The refrigeration circuit of claim 1, wherein the intermediate relief device (a) is configured to relieve the downstream pressure to an intermediate pressure of 5-40 bar.

4. The refrigeration circuit of claim 1, wherein the second compressor unit (10) is supplied via the suction line (9) with refrigerant evaporated in the freezing cold consumer (E4).

5. The refrigeration circuit of claim 1, wherein the line (11, 12) connecting the gas space of the collecting container (3) to the input of the compressor unit (6) bypasses the evaporator (E2, E3).

6. The refrigeration circuit according to claim 1, wherein the refrigerant comprises CO2.

7. The refrigeration circuit according to claim 1, wherein a heat exchanger (E1) is connected upstream of the collecting container (3).

8. The refrigeration circuit according to claim 7, wherein the heat exchanger (E1) is connected or connectible (2, 13) with its input side to the output of the condenser/gas cooler (1).

9. The refrigeration circuit according to claim 7, wherein:

the line (2) from the condenser/gas cooler (1) divides into a first line portion (2') and a second line portion (13);

a relief device (f) is in the second line portion (13); and the refrigerant in the second line portion (13) is evaporated in the heat exchanger (E1) against the refrigerant in the first line portion (2').

10. The refrigeration circuit according to claim 9, wherein the second line portion (13, 14) after the heat exchanger (E1) is connected or connectible to the input of the compressor (6') of the compressor unit (6).

11. The refrigeration circuit according to claim 9, wherein:

a pressure line (7) is provided for leading compressed refrigerant from the compressor unit (6) to the compressor/gas cooler (1); and the pressure line (7) is connected or connectible with the line (2, 2', 2") that connects the condenser/gas cooler (1) and the collecting container (3).

12. The refrigeration circuit according to claim 9, wherein:

a pressure line (7) is provided for leading compressed refrigerant from the compressor unit (6) to the condenser/gas cooler (1); and a line (18) having a valve (j) arranged therein connects the first line portion (2') downstream of the heat exchanger (E1) with the pressure line (7) downstream of the compressor unit (6).

13. The refrigeration circuit according to claim 1, wherein:

a pressure line (7) is provided for leading compressed refrigerant from the compressor unit (6) to the condenser/gas cooler (1); and the pressure line (7) is connected or connectible to the collecting container (3), preferably with the gas space thereof.

14. The refrigeration circuit according to claim 13, wherein a relief valve (h) is provided in a line (17) that connects the pressure line (7) with the collecting container (3).

15. The refrigeration circuit according to claim 1, wherein:

there is a heat exchanger/a subcooler (E5) between the collecting container (3) and the relief device (c, b) connected upstream of the evaporator.

16. The refrigeration circuit according to claim 1, wherein:

there is a heat exchanger (E6) in which the flash gas sucked off from the connecting container (3) is superheated against compressed refrigerant in the pressure line (7).

17. A method for supercritical operation of a refrigeration circuit according to claim 1, wherein:

pressure relief of the refrigerant to an intermediate pressure of 5 to 40 bar is effected in the intermediate pressure relief device (a) arranged between the condenser/gas cooler (1) and the collecting container (3);

refrigerant is sucked off from the collecting container (3), expanded in the relief device (b, c) connected upstream of the evaporator (E2, E3), evaporated in the evaporator (E2, E3) and lead to the compressor unit (6) via a suction line (5);

a refrigerant partial flow is sucked off from the collecting container (3) via the suction line (4) and a line (8) branching off the suction line (4) to the at least one freezing consumer (E4);

the refrigerant partial flow is expanded in the relief valve (d), evaporated in the at least one freezing consumer (E4), and led to the further compressor unit (10);

the further compressor unit (10) compresses the refrigerant partial flow to the input pressure of the compressor unit (6) and leads it via a line (11, 5) to the input side of the compressor unit (6); and the intermediate pressure is regulated to a constant value by means of a relief valve (e) provided in the connection line (11, 12) between the gas space of the collecting container (3) and the input of the compressor unit (6).

18. The method according to claim 17, wherein the refrigerant (2) is subjected to cooling (E1) prior to the pressure relief in the intermediate pressure-relief device (a).

19. The method according to claim 17, wherein the intermediate pressure is regulated to a constant value and/or to a constant difference from the suction pressure by means of at least one valve (e, h, j).

20. The method according to claim 17, wherein the refrigerant (4) withdrawn from the collecting container (3) is subjected to subcooling (E5).

21. The method according to claim 17, wherein the flash gas sucked off from the connecting container (3) is superheated (E6) against compressed refrigerant in the pressure line (7).

22. The method according to claim 17, comprising operating the compressor to circulate a flow of the refrigerant sequentially in the direction of flow through:

the condenser/gas cooler (1);

the intermediate relief device (a);

the collecting container (3);

the relief device (b, c);

the evaporator (E2, E3); and returning to the compressor.

* * * * *